United States Patent [19]

Calegan

[11] 4,055,972

[45] Nov. 1, 1977

[54] COMBINATION-CONTROLLED AND KEY-OPERATED SECURITY PADLOCK

[75] Inventor: Everett L. Calegan, Homewood, Ill.

[73] Assignee: Junkunc Bros. American Lock Company, Crete, Ill.

[21] Appl. No.: 691,864

[22] Filed: June 1, 1976

[51] Int. Cl.[2] ..... E05B 37/06

[52] U.S. Cl. ..... 70/21; 70/25; 70/52; 70/314

[58] Field of Search ..... 70/21, 25, 314, 52, 70/22

[56] References Cited

U.S. PATENT DOCUMENTS

| | | | |
|---|---|---|---|
| 2,148,226 | 2/1939 | Aldeen | 70/25 |
| 2,926,514 | 3/1960 | Junkunc | 70/21 |
| 3,563,067 | 2/1971 | Foote | 70/25 |

*Primary Examiner*—Robert L. Wolfe

*Attorney, Agent, or Firm*—Hill, Gross, Simpson, Van Santen, Steadman, Chiara & Simpson

[57] ABSTRACT

Combination-controlled and key-operated padlock constructed to be partially assembled and stocked. When the lock is to be shipped, a desired key barrel and cylinder subassembly may be selected and assembled to the padlock without any alteration to the padlock or its casing. A two-piece inner back plate is provided, a larger part of which covers the combination tumblers and retains the tumbler post in position and forms a mounting for a pivot shaft for the rocker for the tumbler post. The smaller part of the back plate forms a mounting for a key cylinder subassembly including a key barrel within the key cylinder, a transmission plate movably mounted in the key cylinder and connected with the key barrel to be pivoted about the axis of the key barrel upon turning of the key. The smaller back plate is secured to a lug extending axially of a fin extending radially of the key cylinder so the partial back plate, key cylinder and transmission plate may be assembled to the lock in a simplified operation. Both pieces of the back plate are then held in place by an outer back plate properly registered. The casing for the padlock is rolled about the outer back plate and holds the back plate in position. The rocker for the latch bolt is biased by a torsion spring to pivot the rocker to bring the latch bolt into position to engage a latch bolt receiving notch in the short leg of the shackle as soon as the short leg of the shackle is removed from the casing.

11 Claims, 9 Drawing Figures

COMBINATION-CONTROLLED AND KEY-OPERATED SECURITY PADLOCK

FIELD OF THE INVENTION

Key-operated and combination-controlled padlock of the type found in Class 70, Subclasses 21 through 38.

The present invention is an improvement on the padlock of application Ser. No. 595,598, filed July 14, 1975 by Guillermo W. Lippisch and assigned to the same assignee as the present application and certain features of the prior application are incorporated herein by reference as a part of the present application.

BACKGROUND, SUMMARY AND ADVANTAGES OF INVENTION

Combination-controlled and key-operated shackle-type padlocks having a latch bolt spring-biased into locking engagement with the retaining notch formed in the short leg of a U-shaped shackle, are common at the present time. In many prior designs of such padlocks, such as the Patents to Soref et al U.S. Pat. Nos. 2,113,864; 2,487,608; 2,893,231; Check U.S. Pat. No. 3,009,345 and Markert et al U.S. Pat. No. 3,194,033, a spring-biased latch bolt slidably carried in a rocker secures the shackle in a locked position. Moreover, in such key-operated and combination-controlled padlocks, the key cylinder is assembled to the padlock as the complete padlock is assembled. The combination tumblers and key cylinder are enclosed and held in position by a single inner back plate covered by an outer back plate which is held to the lock casing by a rolling operation. Thus, when the padlock is once assembled, the key barrel and cylinder cannot readily be interchanged.

The present invention not only increases the security of the padlock, but overcomes the deficiencies and short-comings of the prior padlocks by providing a two-piece inner back plate accommodating the padlock to be assembled with the tumbler post for the combination tumblers secured to a larger part of the inner back plate which is riveted or otherwise secured to the pivot shaft for the rocker carrying the latch bolt. The padlock may then be stocked with the combination-controlled mechanism assembled to the padlock. The desired key barrel and cylinder may later be selected with the transmission plate for releasing the latch bolt preassembled to the smaller part of the back plate, to be inserted in the padlock casing in a simple and efficient operation. Thus, where the padlock is to be used for schools and the like, a student may open his padlock by dialing the combination dial, and the supervisor for the locker room may open the padlock by a key, where required. A master key may be provided which will open padlocks of various makes and thus make it unnecessary to stock keys for each individual make of padlock.

A further distinction of the present invention over the prior art references listed above is that the latch bolt is always biased to engage the latch bolt receiving notch in the shackle and the rocker carrying the latch bolt is biased to position the latch bolt in a locking position as soon as the padlock is opened and the shackle is disengaged from the latch bolt.

Another advantage of the invention is in the use of biasing means biasing the rocker in position to position the latch bolt to engage the shackle notch, and in the use of a separate spring to bias the latch bolt to engage the latch bolt receiving notch of the shackle.

Still another advantage of the invention is in the simplicity and effectiveness of the padlock attained by combining the transmission plate for releasing the latch bolt, the key cylinder and key barrel, controlling operation of the transmission plate as a unit, assembled to a smaller back plate of a two-piece back plate assembly for the padlock.

A still further advantage of the invention is by constructing the padlock with an inner and outer back plate and making the inner back plate in two pieces, the larger piece of which is held in position by riveting to the pivot shaft for the rocker while the smaller piece is riveted to the key cylinder which carries the key barrel and transmission plate.

A still further advantage of the invention resides in the construction of the padlock to safeguard against opening of the padlock by tapping, or a blow on the shackle.

Another advantage of the invention resides in the unitary mounting of a transmission plate on the key barrel and cylinder and the retention of the transmission plate to the smaller part of the inner back plate of the padlock by the key cylinder.

A still further advantage of the invention is in the arrangement of the upsetting mechanism for the tumblers by locating the upsetting pawl at a more efficient angle than formerly, and by providing an elongated square-cornered tang for the rocker fitting into the aligned slots in the tumblers when the padlock is released by the combination mechanism and retaining the combination dial from rotation upon an outward pull of the shackle relative to the padlock casing.

Other objects, features and advantages of the invention will be readily apparent from the following description of a preferred embodiment thereof, taken in conjunction with the accompanying drawings, although variation and modifications may be effected without departing from the spirit and scope of the novel concepts of the disclosure.

DESCRIPTION OF PREFERRED EMBODIMENT OF INVENTION

Figure 1:
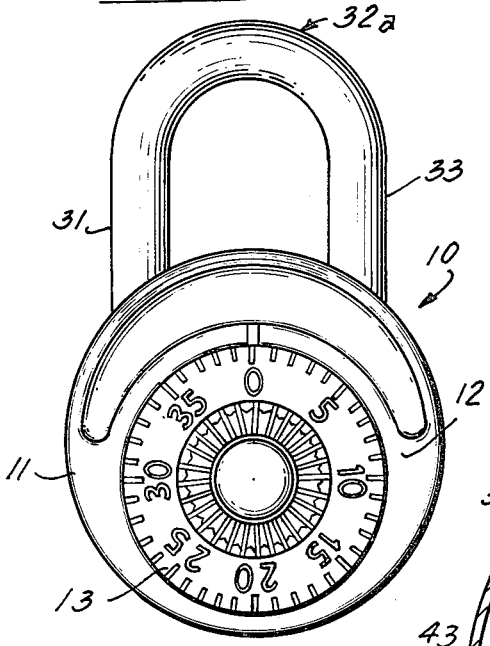
FIG. 1 is a front end view of a combination-controlled and key-operated padlock constructed in accordance with the principles of the present invention.

In the embodiment of the invention illustrated in the drawings, a generally cylindrical padlock casing 10 is shown as including an outer casing 11 having a recessed front plate 12 for receiving a combination dial 13 and an inner casing 15 extending within and generally conforming to said outer casing. The inner casing includes an inner front plate 16 abutting the front plate 12 and having a side wall 17 having a cylindrical outer periphery extending therefrom along the outer side wall of the outer casing. A two-piece inner back plate 18 rests on top of the outer side of the side wall 17 of the inner casing and extends about the inside of the cylindrical side wall of the outer casing. Said two-piece inner back plate includes a first portion 19 shown as being larger than the other portion, but not necessarily larger, and a second portion 20. Said first portion has slots **19*a* opening to the periphery thereof and registering with tangs 21 extending upwardly of the side wall 17 of the inner casing 15 to hold said back plate in position. Said first portion 19 terminates along a chordal line 14 and forms a support for a tumbler post 22 for permutation disks 23, 24 and 25. Said larger part of said inner back plate also forms a support for one end of a transverse pivot pin 26 for a rocker 27 and is staked or otherwise secured thereto. The dial 13 and disks 23, 24 and 25 are of a conventional form and are no part of the present invention, except insofar as they form a means for accommodating pivotal movement of the rocker 27 to release a latch bolt 29 slidably mounted in said rocker from a locking notch 30 in a short leg 31 of a shackle 32.**

The shackle 32 is a conventional form of generally U-shaped shackle having a short leg 31 having the locking notch 30 therein and having a long leg 33. Both legs slidably extend through openings in the cylindrical walls of the registered casings 11 and 15 in a conventional manner. The shackle 32 is thus supported and guided for extensible and retractable movement relative to the inner and outer casings to accommodate removal of the short leg from the casing when the latch bolt 29 is released from the locking notch 30 to open and then close the padlock.

A guide plate 34 is pivotally mounted on the inner end of the long leg of the shackle and is guided along a slide 28 projecting from the wall 16 of the inner casing 15 between limiting surfaces **28*a* and 28*b* and forms a guide for said shackle and limits inner and outer movement relative to the padlock casing. The opposite end of the shackle plate is slidable guided in a slot 34*a* in the larger part 19 of the two-piece inner back plate 18. The longer leg of the shackle thus provides extensible guided movement of the shackle 32.**

The rocker 27 comprises a guide and support for the latch bolt 29 and is rockingly supported on the transverse rocker pin 26. The latch bolt 29 is slidably received in a socket 35 in the rocker 27 which opens toward the short leg of the shackle and the locking notch 30 thereof. The socket and latch bolt may either be rectangular or cylindrical in cross section.

Figure 3:
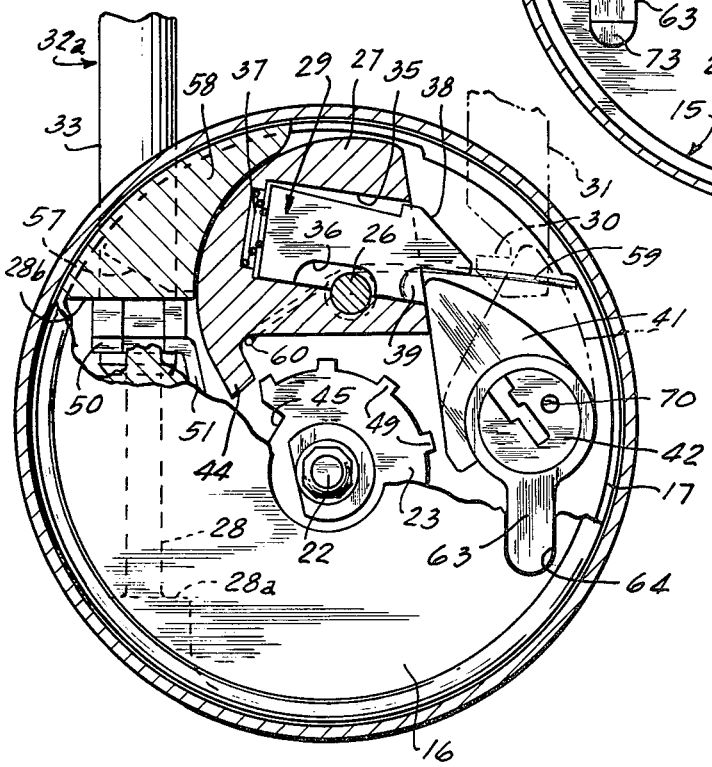
FIG. 3 is a fragmentary sectional view taken through the padlock, but looking at the padlock from the opposite side from FIG. 2, and showing the latch bolt released by the transmission plate secured to the key barrel.
Figure 9:
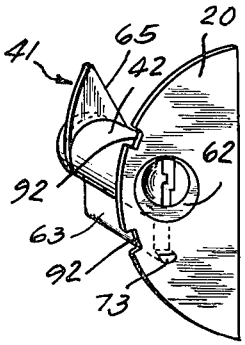
FIG. 9 is an isometric view showing the back plate part forming a support for the key cylinder.

As shown in FIG. 3, the latch bolt 29 has an elongated bottom opening notch 36 therein, extending over the pivot pin 26 and limiting rectilinear movement of said latch bolt along said notch. A compression spring 37 seated in the socket 35 serves to extensibly move a nose 38 of the latch bolt into the locking notch 30 in a conventional manner.

Figure 4:
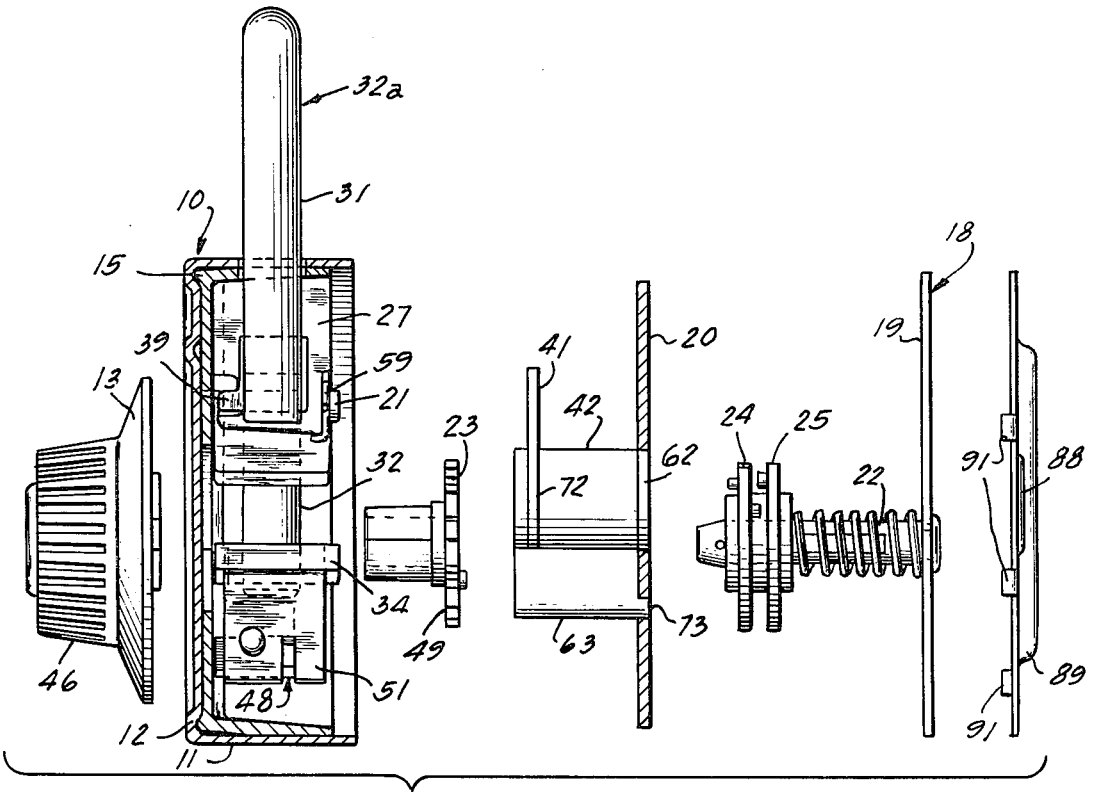
FIG. 4 is an exploded view of the padlock with the lock casing shown in section to show the inner casing and lug extending from the latch bolt to accommodate release of the latch bolt by the transmission plate.
Figure 6:
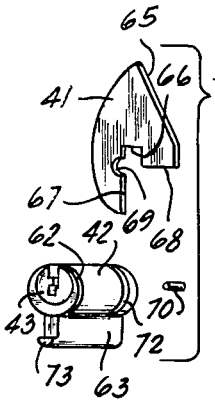
FIG. 6 is an exploded view of the key cylinder and plug and transmission plate fitting in the slot in the key cylinder.

The latch bolt 29 also has an ear 39 projecting laterally from one side thereof beneath and adjacent a rear end portion of the nose 38 (FIGS. 3 and 4) to be engaged by a transmission plate 41 rotatably carried in a key cylinder 42 and operated by turning movement of a key plug 43 relative to the key cylinder, as a key is placed in the key plug to turn the plug, as will hereinafter more clearly appear as this specification proceeds.

A tongue 44 extends from the lower portion of the rocker 27 adjacent the long leg of the shackle for engagement with the peripheral surfaces of one or more of the permutation or tumbler disks 23, 24, 25, to restrict the latch bolt 29 to a shackle securing orientation, whenever the disks 23, 24 and 25 and slots 45 in said disks are out of alignment with each other. The permutation or tumbler disk 23 is usually termed a driving disk and is turned by a knob 46 extending from the dial 13 to rotatably drive a next adjacent permutation disk 24, which may in turn drive a permutation or tumbler disk 25 to align outwardly opening slots 45 in said tumbler disks, as shown in FIG. 3, to accommodate the tongue 44 to enter the aligned slots 45. When the slots 45 are in registry with each other, in position to admit the tongue 44, an outward pull on the shackle 32 will pivot the rocker 27 about the pin 26 and thereby bring the latch bolt 29 out of locking engagement with the notch 30 in the short leg of the shackle. As shown in the drawings, the tongue 44 is square-cornered as are the slots 45, except said slots have outwardly beveled sides to readily receive the tongue 44.

When the shackle 32 is depressed into the casing 10, the shackle leg 33 will cam the latch bolt 29 against the bias of the spring 37 to reestablish locking engagement between the latch bolt 29 and the notch 30 of the short leg 31 of the shackle. During this retractable movement of the shackle 32 into its locked position, an upsetter pawl 48 on the lower end of the long leg of the shackle, beneath the shackle guide 34, serves to engage spaced radial projections or lugs extending from the tumbler disk 23 to bring the slots 45 out of registry with each other. The tumbler disk construction and arrangement and upsetter pawl 48 are similar to those shown in U.S. Pat. No. 2,926,514 which issued to George P. Junkunc on Mar. 1, 1960, assigned to the assignee of the present application and incorporated herein as a part of this specification.

Legs 50 and 51 of an upsetter guide support the upsetter pawl, and, instead of being at an angle of 90° with respect to each other, as shwon in the aforementioned Junkunc U.S. Pat. No. 2,926,514, are at an angle of greater than 90° to position the upsetter pawl 48 at a more advantageous angle to upset the tumbler disks and misalign the slots 45 relative to each other. The angle of said legs is herein shown as being in the order of 100°, although the angle may vary in accordance with the diameters of the tumbler disks and the size of the padlock, but is preferably greater than 90°.

The horizontal leg 50 of the upsetter guide has a slotted portion (not shown) guided for movement along the slide 28 and a lug 53 at its opposite end guided for movement along the slot **34*a* in the back plate part 19. The upsetter pawl 48 has two ratchet surfaces 54 and 55 engaging lugs 49 projecting radially outwardly from the lower disk 23 and engaging the driving pin driving the disk 25 from the disk 23,** as in the aforementioned Junkunc U.S. Pat. No. 2,926,514.

The rocker 27 also has a stabilizing and stop segment 57 extending from and formed integrally therewith along one side of a back-up guide 58 to stabilize rocking movement of the rocker and serve as a stop limiting inward movement of the shackle and release of the latch bolt by cyclic tapping on the shackle or a heavy blow on the shackle. The stabilizing and stop segment 57 cooperating with the back-up guide 58 provides lateral stability for the rocker 27 as it pivots about the pin 26 as in the aforementioned Lippisch application Ser. No. 595,598. The back-up guide 58 has an arcuate face conforming to the periphery of the rocker 27 while the stabilizing fin 57 has an arcuate face conforming to the inner periphery of the wall 17 of the inner casing 15. Since the stabilizing fin and back-up guide have been clearly shown and described in the aforementioned Lippisch application Ser.No. 595,598, a further description thereof need not be necessary.

Figure 2:
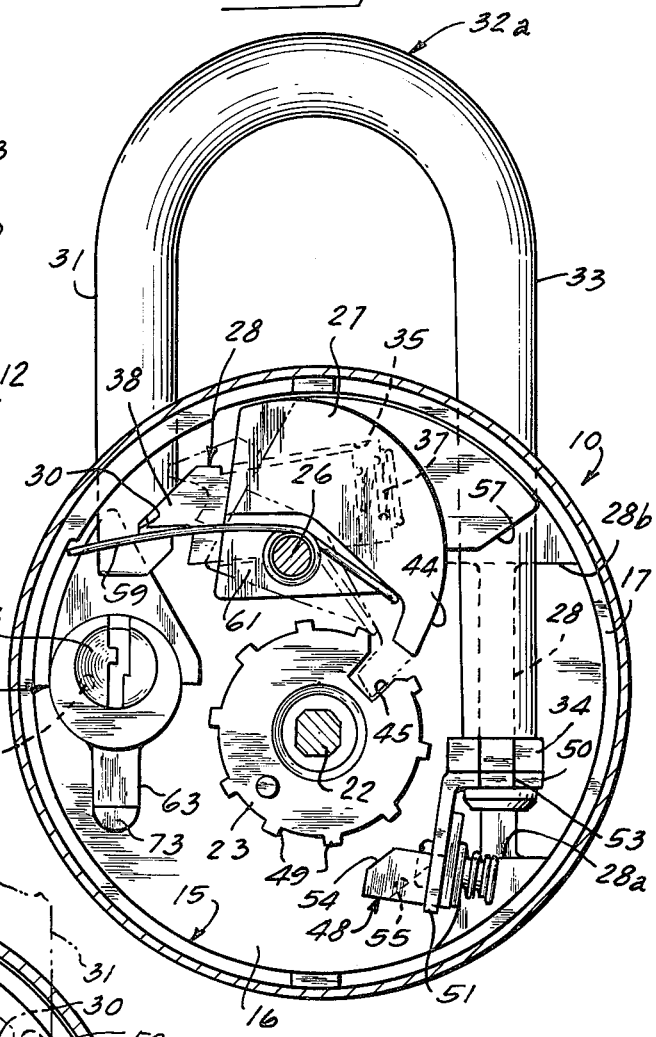
FIG. 2 is a sectional view taken through one side of the casing of the padlock shown in FIG. 1 looking at the padlock from the back with the back plate removed, and showing the padlock in a locked condition.

The rocker 27 is biased in position, to position the latch bolt in a locking position as soon as the short leg of the shackle is withdrawn from the padlock casing, by a torsion spring 59 coiled about the pivot pin 26. One leg of the torsion spring 59 abuts the inside of the cylindrical side wall 17 while the opposite leg of the torsion spring has a right-angled portion 60 extending under the rocker 27 to bias the tongue 44 out of the slots 45 of the tumblers 23, 24 and 25 and thereby position the latch bolt into position to engage the notch 30 in the short leg 31 of the shackle, as the shackle is inserted in the padlock casing. As shown in FIG. 2, the rocker has a recessed portion 61 formed therein to receive both legs of the torsion spring 59 and thereby frees said spring from interference with the two-piece back plate 18 when said back plate is held in position.

Referring now in particular to the key cylinder 42, key plug 43 and transmission plate 41, the key plug may be of a conventional form. The key plug has a shouldered portion 62 flush with the outer periphery of the key cylinder. The key cylinder otherwise extends about the key plug and has a generally radial fin 63 projecting from its periphery and fitting in a slot 64 formed in the wall 16 of the inner casing 15. The radial fin 63 extends along the key cylinder for its entire length. The slot 64 terminates into a cylindrical recess to receive the end of the key cylinder carrying the transmission plate 41. The transmission plate 41 has an inclined latch bolt engaging surface 65 engageable with the ear 39 projecting laterally of the latch bolt, and has a back surface generally conforming to the interior cylindrical wall portion of the inner casing 15. The transmission plate also has a rectangular recessed portion 66 having an inner wall 67 extending downwardly therefrom and to the bottom of the arcuate wall and a wall 68 extending at right angles with respect thereto toward a camming surface 69 of the transmission plate. The wall 67 has a semicircular notch 69 therein to fit a pin 70 in the key plug 43.

The key cylinder also has a slot 72 formed therein generally conforming to the recess 66 and walls 67 and 68 to receive the transmission plate. The walls 67 and 68, as well as the recessed portion 66, form a stop for the transmission plate and cooperate with the pin 70 to accommodate a key in the key plug 43 to positively turn the transmission plate relative o the key cylinder to release the nose of the latch bolt 29 from the locking slot 30 in the short leg 31 of the shackle.

The fin 63 extending radially of the key cylinder has a lug 73 projecting therefrom and shown as being in the from of a sector of a circle engageable with an apertured portion 74 of the second part 20 of the two-piece inner back plate 18, to accommodate insertion of the part 20 along with the key cylinder and transmission plate in position in the inner casing 15, with the camming surface 65 of the transmission plate 41 in position to engage the ear 39 extending from the latch bolt 29 and release said latch bolt from the locking notch 30 in the short leg of the shackle 32.

Thus, when the radial fin 63 is in position to accommodate the lug 73 to be riveted to the part 20 of the back plate and the key barrel is in position in its circular opening in the back plate and the lug 73 is staked to the back plate part 20, a chordal surface 80 of said part will abut a chordal surface 14 of the part 19 of the back plate 18. The transmission plate 41 will then be positioned with its inclined camming surface 65 in position to engage the ear 39 and cam the latch bolt to a released position upon the placing of a key in the key barrel and turning the barrel in a direction to release the latch bolt.

Figure 7:
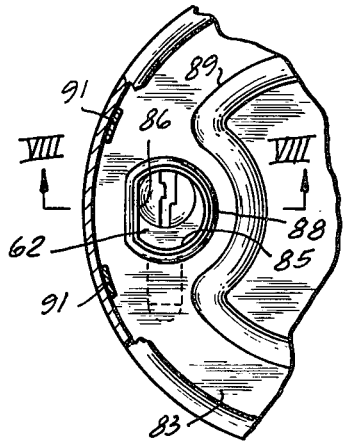
FIG. 7 is a fragmentary view of the back plate of the padlock assembled to the padlock casing with certain parts of the casing shown in section.
Figure 5:
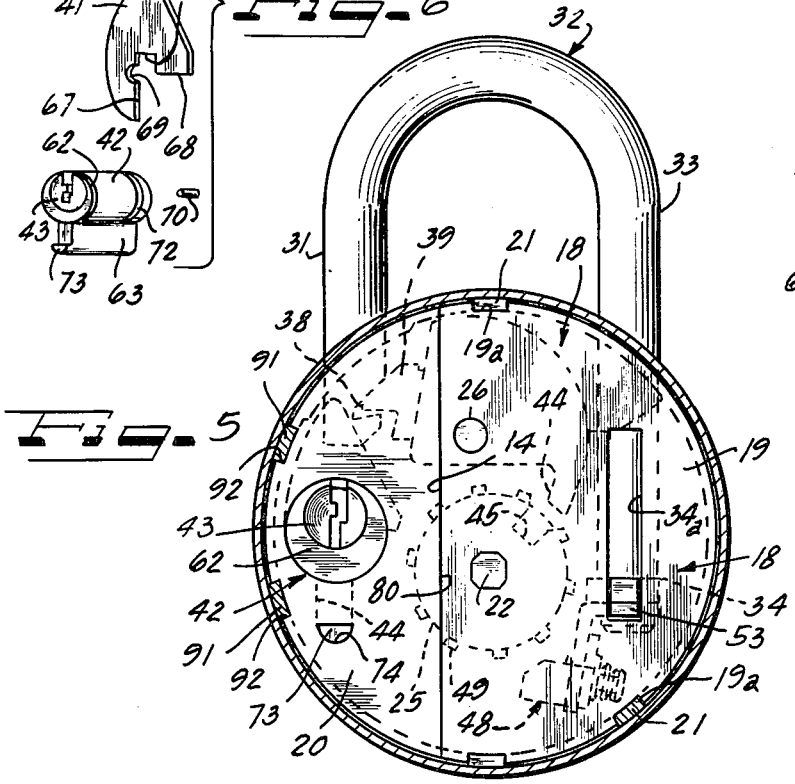
FIG. 5 is a sectional view taken through the outer casing for the padlock and showing the two-part inner back plate.
Figure 8:
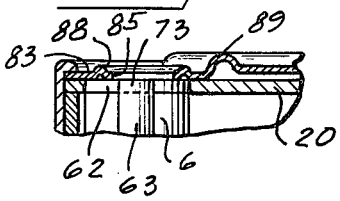
FIG. 8 is a partial fragmentary sectional view taken substantially along line VIII—VIII of FIG. 7.

The back plate part 20 is held in position in the lock casing in engagement with the cylindrical side wall 17 thereof by an outer back plate 83 held to the back plate parts by rolling the cylindrical wall of the outer casing along the outer back plate, as shown in FIGS. 7 and 8.

The outer back plate, prior to assembly to the locking casing is provided with an apertured portion 85 to afford access to the key plug by a key. The apertured portion 85 is generally circular, but terminates at a chordal line 86 along the outside of the back plate, to reduce the size of the apertured portion and thereby decrease the material cut from the back plate and strengthen the back plate.

The outer back plate 83 further is provided with an outwardly extending embossment 88 extending about said apertured portion 85 and thereby strengthening the back plate about said apertured portion.

The outer back plate 83 is further strengthened by an embossment 89 extending thereabout and conforming to the periphery thereof, but spaced inwardly therefrom and also recessed to conform to the outer apertured portion 85. The outer back plate also has a plurality of tangs 91 extending inwardly therefrom and registrable with a pair of spaced slots 92 recessed in the periphery of the back plate part 20 and with a slot 93 in the back plate part 19 to retain the inner back plates in registry with each other and to hold the outer back plate in a proper position as placed on the two-part inner back plate. The outer back plate thus serves to aid in retaining the two-part inner back plate in position with the chordal surfaces thereof in abutting engagement with each other and to retain said back plates to the padlock casing as the edge of the cylindrical wall of the outer casing is rolled over said outer back plate.

It may be seen from the foregoing that an improved and rugged combination tumbler and key-operated padlock has been provided in which the shackle 32 is safeguarded against unauthorized opening by a blow on the shackle or cyclic tapping thereon and that the padlock may be partially assembled, except for the key cylinder and transmission plate, and then when shipped for use, a selected key cylinder assembly, including the inner back plate part 20, the key cylinder and key plug and transmission plate, may readily be assembled in position to effect release of the latch bolt by a key. When the back plate part 20, key cylinder and transmission plate are once assembled and the outer casing is rolled about the outer back plate, the padlock forms a rugged, tamper-proof lock safeguarding against unauthorized release by the permutation mechanism or an unauthorized key.

I claim as my invention:

1. In a permutation and key-operated padlock, an outer casing having an outer wall having a pair of parallel spaced openings therein, a U-shaped shackle slidably carried in said openings and having a shorter leg having a latch bolt receiving notch therein, a rocker assembly mounted within said casing between the legs of said shackle, a pivot pin forming a pivotal mounting for said rocker assembly, a latch bolt slidably carried in said rocker assembly, a spring seated in said rocker assembly and biasing said latch bolt to engage said latch bolt receiving notch, permutation-controlled release means for said latch bolt to accommodate release of said latch bolt from said shackle upon outward pulling movement on said shackle, spring means biasing said rocker to position said latch bolt into a latching position upon release of said shackle and key-operated means engageable with said latch bolt to release said latch bolt from said shackle independently of said permutation-controlled release means, a two-part inner back plate closing said casing, one part forming a mounting for one end of said pivot shaft for said rocker and the other part forming a mounting for said key cylinder and transmission plate, and bodily mounting said key cylinder and transmission plate in said casing.

2. The padlock of claim 1 in which the spring means is a torsion spring carried about said pivot pin and having one leg engaging the inside of said casing and a second leg engaging said rocker and biasing said rocker to position said latch bolt into a locking position upon release of said key-operated means.

3. The padlock of claim 1 in which the key-operated means includes a key barrel, a key cylinder receiving said key barrel and a transmission plate mounted on said key cylinder connected to said key barrel to rotate therewith upon turning movement of said key barrel within said key cylinder by a key.

4. The padlock of claim 3 in which the key cylinder has a member extending radially therefrom having lug means extending axially therefrom in an opposite direction from said transmission plate, and wherein said other back plate part has an opening therein engageable with said lug means to hold said key cylinder from turning movement and to accommodate said lug means to be staked to said other back plate part.

5. The padlock of claim 4, wherein an outer back plate extends over said inner back plates and has a key opening therein and tangs spaced about the periphery thereof for registering said outer back plate with said inner back plates and said key opening with said key cylinder.

6. The padlock of claim 5, wherein the key opening is partially circular in form and has a flattened portion adjacent the outer periphery of said outer back plate to reduce the size of said key opening and the metal taken from said outer back plate.

7. The padlock of claim 6, wherein an embossment extends about said key opening and partially conforms to the form thereof and another embossment of larger diameter extends about said outer back plate and has a portion formed to conform to the form of said key opening.

8. The padlock of claim 5 in which the latch bolt has a member projecting from one side thereof forming an engaging surface of said transmission plate to release the latch upon turning movement of said key plug and transmission plate relative to said key cylinder by a key.

9. The padlock of claim 8 in which the transmission plate is riveted to said key plug for movement relative to said key cylinder upon the turning of a key in said key plug.

10. The padlock of claim 9 in which the other back plate part, key cylinder and key plug are assembled as a unit to accommodate a selected key plug and cylinder to be assembled to said padlock after assembly of the padlock except for the key plug and cylinder and prior to assembly of the outer back plate.

11. A padlock having a casing having an outer wall having shackle rceiving holes therein, a shackle slidably mounted in said holes and having a short leg having a latch bolt receiving notch therein, and a longer leg guided in said casing, a latch bolt guided for rectilinear movement into said notch to lock the lock, a spring biasing said latch bolt into engagement with said notch, an inner back plate part partially extending over said padlock, and partially enclosing said padlock, and having a chordal wall exposing said latch bolt, a transmission plate for releasing said latch bolt, a key plug, a key cylinder forming a mounting for said key cylinder, and having a radial lug projecting therefrom and engageable with said casing, to hold said key cylinder from turning movement.

means rotatably mounting said transmission plate on said key cylinder, other means connecting said transmission plate to said key plug to turn said transmission plate relative to said key cylinder, by turning a key in said key plug to release said latch bolt from said locking notch in the short leg of said shackle, a second inner back plate having a chordal wall adapted to abut the chordal wall of said first-mentioned back plate part, and having an opening therein to afford access to said key cylinder, lug means extending laterally from said radial lug, an opening in said second inner back plate part receiving said lug means extending laterally from said radial lug, and accommodating said lug means to be staked to said second back plate, to provide a unitary transmission plate, key plug, key cylinder and second back plate assembly to accommodate said assembly to be bodily inserted in the padlock, and an outer back plate retained to said outer wall of said casing and retaining said second back plate in position in said casing.

* * * * *